US006635681B2

(12) United States Patent
Moore, Jr. et al.

(10) Patent No.: US 6,635,681 B2
(45) Date of Patent: Oct. 21, 2003

(54) METHOD OF FUEL PRODUCTION FROM FISCHER-TROPSCH PROCESS

(75) Inventors: Richard O. Moore, Jr., San Rafael, CA (US); Mark Schnell, Gerrards Cross (GB)

(73) Assignee: Chevron U.S.A. Inc., San Ramon, CA (US)

( * ) Notice: Subject to any disclaimer, the term of this patent is extended or adjusted under 35 U.S.C. 154(b) by 6 days.

(21) Appl. No.: 09/860,600

(22) Filed: May 21, 2001

(65) Prior Publication Data

US 2002/0173556 A1 Nov. 21, 2002

(51) Int. Cl.[7] ..... C07C 27/00; C07C 7/20; C10G 73/00; C10G 35/00; C10G 47/00

(52) U.S. Cl. ..... 518/700; 208/24; 208/133; 208/107; 585/1; 585/899

(58) Field of Search ..... 518/700; 208/24, 208/133, 107; 585/899, 1

(56) References Cited

U.S. PATENT DOCUMENTS

| | | | | |
|---|---|---|---|---|
| 4,579,985 A | | 4/1986 | Minderhoud et al. | |
| 5,292,989 A | | 3/1994 | Davis | |
| 5,766,274 A | * | 6/1998 | Wittenbrink et al. | 44/436 |
| 5,856,260 A | | 1/1999 | Mauldin | |
| 5,856,261 A | | 1/1999 | Culross et al. | |
| 5,863,856 A | | 1/1999 | Mauldin | |
| 5,866,751 A | | 2/1999 | Womack, Jr. et al. | |
| 5,945,459 A | | 8/1999 | Mauldin | |
| 5,968,991 A | | 10/1999 | Mauldin | |
| 6,294,076 B1 | * | 9/2001 | Gentti et al. | 208/24 |

FOREIGN PATENT DOCUMENTS

| | | | |
|---|---|---|---|
| EP | 1 004 746 A1 | | 5/2000 |
| EP | 1 156 026 A1 | | 11/2001 |
| GB | 2 375 770 A | | 11/2002 |
| WO | 97/12118 | * | 4/1997 |

* cited by examiner

*Primary Examiner*—J. Parsa
(74) *Attorney, Agent, or Firm*—Burns, Doane, Swecker & Mathis, L.L.P.

(57) ABSTRACT

A process is disclosed for preparing a finished fuel product from a stabilized product mixture, which is produced from the effluent of a Fischer-Tropsch synthesis process. In the process, a Fischer-Tropsch synthesis process is conducted at a site which is remote from the market site where the products from the process are ultimately marketed. The Fischer-Tropsch effluent product is hydroprocessed, and the hydroprocessed effluent separated to remove a $C_4$– fraction and to yield a stabilized product mixture which can be exported to the market site. At the market site, the stabilized product mixture is fractionated into at least one finished fuel product. A heavy fraction may also be recovered at the market site for separation into at least one lubricating oil base stock and then conversion at hydroisomerization conditions to form a lubricating base oil.

25 Claims, No Drawings

METHOD OF FUEL PRODUCTION FROM FISCHER-TROPSCH PROCESS

FIELD OF THE INVENTION

The present invention is directed to a method for preparing liquid fuel in a hydrocarbon synthesis process, and more specifically for preparing a stabilized mixed fuel from a carbon source at a remote site, and tailoring one or more finished fuel products from the mixed fuel in order to meet local fuel requirements at a market site.

BACKGROUND OF THE INVENTION

Many of the huge natural gas reserves which are targeted for hydrocarbon fuel synthesis processes, such as a Fischer-Tropsch process, methanol synthesis and the like are generally remote from major fuel markets. Consequently, most or all of the products from the synthesis process are exported from the remote site, generally to multiple markets, each with potentially different fuel needs and requirements.

In the conventional synthesis process, a natural gas, coal or heavy oil is generally converted to liquid hydrocarbons at a site adjacent to the natural resource. In the Fischer-Tropsch process, a carbon-based resource is converted to syngas (predominantly CO and $H_2$) and the syngas converted to a primarily paraffinic hydrocarbon product. In preparing a fuel, the paraffinic hydrocarbons in the conventional process are hydroprocessed to remove at least some of the oxygenates and olefins in the product, to reduce the molecular weight of the product, and to lower the cloud point and/or the pour point of the product. A final distillation step in the conventional process provides the finished fuel and lube product for export to the various markets.

However, the conventional method has several disadvantages. For one, the conventional processes are complex and expensive, with multiple processing steps conducted at the remote site. Developing the site and transporting equipment to the site is generally more costly that using existing processes at a more developed market site. Furthermore, much of the product from a remote site process is exported, generally to more than one market site. Each of these market sites have potentially different fuel requirements and needs. Finished fuel product prepared at the remote site must be tailored to meet the specific requirement of each market.

Methods for transporting Fischer-Tropsch derived syncrude from a remote site to a commercial refinery are known in the art (See, for example, U.S. Pat. Nos. 5,968,991; 5,945,459; 5,856,261; 5,856,260 and 5,863,856). One approach has been to isolate a C20–36 syncrude and ship this composition as a solid. A limitation of this approach is that it is difficult and expensive to transport solids, because it requires expensive forming, loading and unloading facilities.

Other approaches have focused on transporting syncrude, or a syncrude which has been partially refined to convert some of the linear hydrocarbons into isoparaffins and thus generate a syncrude which is liquid at near ambient temperature. One approach to transporting syncrude in the liquid state involves partially dewaxing the syncrude to form a pumpable liquid (See, for example, U.S. Pat. No. 5,292,989). However, this dewaxing may require the construction of facilities which are expensive and difficult to operate in remote locations.

Another approach involves transporting the syncrude as a molten wax. This transportation method does not require the forming, loading and unloading facilities needed to transport solids, or the dewaxing facilities needed to convert the syncrude into a product that is liquid at room temperature.

However, Fischer-Tropsch products include a sufficient quantity of volatile hydrocarbons to cause the products to exceed the vapor pressure specifications if the syncrude were shipped at a temperature at which the syncrude is molten.

What is needed is a process for preparing a finished fuel from a remote hydrocarbon synthesis process, while reducing the processing complexity of the process at the remote site. What is also needed is a more effective method for tailoring the final product from the synthesis process for each individual market.

BRIEF DESCRIPTION OF THE INVENTION

The present invention relates to a Fischer-Tropsch synthesis process, and to an integrated process for preparing a stabilized product mixture, in a Fischer-Tropsch synthesis process, for export to a market location. In the process, a carbonaceous source which is recovered from a remote site is converted through a series of steps into a stabilized product mixture at or near the remote site. At least a portion of stabilized product mixture is then exported to a market location, for a final separation step to produce at least one finished fuel product. More specifically, in the present process, a carbonaceous source, such as natural gas, coal or heavy oil, which is recovered as a resource at a remote site, is converted to a syngas comprising predominantly $H_2$ and CO. The syngas is further converted to synthetic hydrocarbons in a hydrocarbon synthesis process, and the synthetic hydrocarbon product so produced are converted to a stabilized product mixture for export to a market location. A Fischer-Tropsch synthesis process is the preferred process for preparing the synthetic hydrocarbons.

In the preparation of the stabilized product mixture, the synthetic hydrocarbon product is upgraded via hydroprocessing, at conditions selected to yield a stabilized product mixture which comprises fuel and/or lubricating oil base stock range products. At least one of the products present in the stabilized product mixture has the properties of a finished fuel product, and can be recovered as such by an additional distillation step.

In one embodiment, the invention provides a method for preparing finished products from a Fischer-Tropsch synthesis process, the method comprising:

(a) reacting a synthesis gas comprising $H_2$ and CO to form at least one Fischer-Tropsch effluent product;

(b) reacting at least a portion of the Fischer-Tropsch effluent product at hydroprocessing conditions to form a hydroprocessed effluent;

(c) separating at least a portion of the hydroprocessed effluent into at least a $C_4$– fraction and a stabilized product mixture;

(d) transporting at least a portion of the stabilized product mixture to a market site; and (e) separating at least a portion of the stabilized product mixture at the market site into at least one finished fuel product.

In a separate embodiment, the invention provides a method for preparing finished products from a Fischer-Tropsch synthesis process, the method comprising:

a) receiving a stabilized product mixture recovered from a Fischer-Tropsch synthesis process, which stabilized product mixture is prepared by the process comprising:
   i) reacting a synthesis gas comprising $H_2$ and CO to form at least one Fischer-Tropsch effluent product;
   ii) reacting at least a portion of the Fischer-Tropsch effluent product at hydroprocessing conditions to form a hydroprocessed effluent;

iii) separating at least a portion of the hydroprocessed effluent into at least a $C_4$– fraction and a stabilized product mixture; and iv) transporting at least a portion of the stabilized product mixture to a market site;

b) separating at least a portion of the stabilized product mixture without additional hydroprocessing into at least one finished fuel fraction at the market site;

wherein the stabilized product mixture is prepared at a remote site relative to the market site.

A preferred stabilized product mixture comprises:

(a) greater than 80 wt % paraffins, (b) less than 200 ppm oxygen as oxygenates, (c) less than 50 ppm sulfur, (d) less than 50 ppm nitrogen, and (e) less than 5% (v/v) olefins.

For mixtures of this type, most or all of the stabilized product mixture is recovered from a step of hydroprocessing.

Among other factors, the present invention includes Fischer-Tropsch synthesis, upgrading the synthesis product (preferably by one or more of hydrotreating, isomerization and hydrocracking), and stabilizing the resultant full boiling range liquid product. The process further includes separating the full boiling range liquid product to final finished products meeting specification requirements. In the process of the invention, all the major processing steps are conducted at a remote site except for final fractionation, which is conducted at a market site. This invention significantly reduces remote site operating complexity by moving the final distillation step from the remote site to the market site, with equipment suitable for distillation and processing in order to make the finished fuel product. Since final product separation is carried out at the market site, final product separation can be tailored to the particular market to which the stabilized product mixture is exported, rather than being anticipated at the remote site.

DETAILED DESCRIPTION OF THE INVENTION

This invention is directed to a process for converting remote natural gas to liquid fuels and/or lubricating oil base stocks while minimizing the complexity of the remote site processing, and while minimizing the difficulty and expense of transporting the products from the remote site to a market site. As used herein, the market site represents a site near to the ultimate market for the finished fuel products which are prepared in the process. The market site may be a marketing terminal, or a fractionation terminal or refinery for separating the stabilized product mixture into the finished fuel products. The market site preferably has the capability for producing and/or marketing finished fuels and lubricating oil base stocks.

The Fischer-Tropsch synthesis process is conducted at a remote site, sufficiently separated from the market site so that the stabilized product mixture is transported from the Fischer-Tropsch synthesis process to the market site, using transportation media such as by ship, by truck, by train, by barge, and the like.

The stabilized product mixture is prepared at a remote site, near the source of the carbonaceous material from which the stabilized product mixture is made, and at a distance from the distillation site at which the material is separated into fuel products for sale. The market site may be a refinery or other existing processing facility with the capability of producing a finished product from the stabilized product mixture. Preferably, the market site comprises a means of distilling the stabilized product mixture into one or more finished fuel products. The remote site is at a location separate from a refinery, distillation site and/or market site and which generally has a higher cost of construction than the cost of construction at the refinery or market. In quantitative terms, the distance between the remote site and the refinery or market (the distance of transportation) is more than 100 miles, preferably more than 500 miles, and most preferably more than 1000 miles. Transportation of the stabilized product mixture is by ship, train, truck transport, pipeline, and the like. Preferably, at least a portion of the transportation of the stabilized product mixture will occur via ship.

The stabilized product mixture is a broad boiling range product, substantially free of $C_4$– material, and comprising at least one fuel fraction, preferably at least one diesel fraction. In the process, a stabilized product mixture is prepared in a Fischer-Tropsch synthesis process, which includes a Fischer-Tropsch reaction zone and optionally one or more hydroprocessing reaction zones for upgrading the effluent from the Fischer-Tropsch reaction zone and optionally one or more fractionation zones for removing a substantial portion of the $C_4$– components from the upgraded effluent. This stabilized product mixture is in condition for transportation by, e.g. ship, train, truck transport, pipeline, and the like. In particular, the stabilized product mixture has a true vapor pressures of less than about 15 psia, preferably less than about 11 psia, when measured at its transportation temperature.

The stabilized product mixture, which is recovered from a Fischer-Tropsch synthesis process at a remote site, is then separated into at least one fuel fraction, preferably at least one finished diesel fraction, at a market site which is separate from the remote synthesis process site. The stabilized product mixture is preferably prepared at the remote site in such a way that additional hydroprocessing is not necessary at the market site. However, it may be desirable under some conditions to mildly hydrotreat the stabilized product mixture at the market site to remove contaminants accumulated in the product during transportation.

The stabilized product mixture recovered from the Fischer-Tropsch synthesis process is a highly paraffinic mixture, substantially free of $C_4$–. In the embodiment in which the entire stabilized product mixture is derived from a hydroprocessing step, it will contain few, if any, olefins and heteroatoms.

Under these conditions, the preferred product mixture comprises:

i) greater than 80 wt %, preferably greater than 90 wt % and more preferably greater than 95 wt % paraffins;

ii) less than 200 ppm oxygen as oxygenates;

iii) less than 50 ppm sulfur;

iv) less than 50 ppm nitrogen; and v) less than 5% olefins.

Depending on the boiling range of the stabilized product mixture, the stabilized product mixture may be separated into at least one fuel fraction and further into at least one lubricating oil base stock fraction. The fuel fraction, preferably a fuel fraction boiling in the diesel boiling range, is suitable for use in a diesel engine. The lubricating oil base stock is suitable for hydroisomerization to produce a low pour point, high quality lubricating base oil.

In the Fischer-Tropsch synthesis process, a synthesis gas comprising $H_2$ and CO are reacted in a Fischer-Tropsch reaction zone over a Fischer-Tropsch catalyst to produce at least one Fischer-Tropsch effluent product. The stabilized product mixture is derived from the effluent of a Fischer-Tropsch reaction zone. In one embodiment of the invention, the stabilized product mixture is recovered directly from a Fischer-Tropsch reaction zone. Either the entire $C_5$+ effluent, or a fraction thereof, such as one having an endpoint in the range of 650–750° F., are suitable for use in the present invention. When the reaction zone effluent stream contains excess $C_4$− material, thus rendering the effluent unsafe for transportation, some separation of the $C_4$− material may be required, such as by fractionation, by flash distillation, or by stripping with an inert or hydrocarbonaceous gas.

In a separate embodiment of the invention, a stabilized product mixture is prepared by hydroprocessing at least a portion of at least one Fischer-Tropsch effluent product at hydroprocessing conditions. The effluent stream to be hydroprocessed may be the entire Fischer-Tropsch reaction zone effluent or some fraction thereof (i.e. the total $C_5$+ effluent from the reaction zone; a light stream boiling in the range of $C_5$+ to an endpoint in the range of 650–750° F.; a wax fraction having an initial boiling point in the range of 650–750° F.; or a wax fraction having an initial boiling point in the range of 650–750° F. and an end point in the range of 950–1150° F.). The hydroprocessing process may include one or more of hydrocracking, hydrotreating and/or hydroisomerization. Fischer-Tropsch reaction zone effluents having an endpoint in the range of 650–750° F. may preferably be hydroprocessed using one or both of hydrotreating and hydroisomerization. For such a stream, the oxygenates and olefins which may be present in the effluent stream are saturated by hydrotreating, and the normal paraffins in the effluent stream are at least partially isomerized to low pour products, thus upgrading the stream without overly cracking it to less desirable light products. The 650–750° F. endpoint stream may also be blended without hydroprocessing with a heavier Fischer-Tropsch effluent stream which has been hydroprocessed prior to blending.

A Fischer-Tropsch effluent stream containing components boiling in the range above 650–750° F. may suitably be hydrotreated to remove oxygenates and olefins, and/or hydrocracked to reduce the boiling range of the effluent stream, and/or hydroisomerized to reduce the pour point of the effluent stream and make handling and shipping of the stabilized product mixture derived therefrom easier. A hydroprocessed stabilized product mixture produced in this manner will have the following properties:

i) greater than 80 wt % paraffins (>90 wt %, >95 wt %), ii) less than 200 ppm oxygen as oxygenates, iii) less than 50 ppm sulfur, iv) less than 50 ppm nitrogen, and v) less than 5% (v/v) olefins.

Following transportation of the stabilized product mixture from the remote site to a more developed site, the stabilized product mixture is fractionated into finished fuel products. Preferably, the stabilized product mixture requires no processing other than fractionation of the stabilized product mixture to make the finished fuel components which are ready for addition of optional additives for sale as finished fuels. The additives which might be added are well known in the art. The additives are proprietary products which vary from vendor to vendor; the choice of any additive is within the scope of the present invention. In some situations it may be desirable to mildly hydroprocess the stabilized product mixture by mild hydrotreating or hydrofinishing, in order to remove oxidation products or contaminants which were introduced to the $C_5$+ material during transportation. A finished diesel fuel suitable for use in diesel engines conforms to the current version at least one of the following specifications:

ASTM D 975—"Standard Specification for Diesel Fuel Oils",

European Grade CEN 90,

Japanese Fuel Standards JIS K 2204,

The United States National Conference on Weights and Measures (NCWM) 1997 guidelines for premium diesel fuel, or The United States Engine Manufacturers Association recommended guideline for premium diesel fuel (FQP-1A).

A finished jet fuel suitable for use in turbine engines for aircraft or other uses meets the current version of at least one of the following specifications:

ASTM D1655-99,

DEF STAN 91-91/3 (DERD 2494), TURBINE FUEL, AVIATION, KEROSENE TYPE, JET A-1, NATO CODE: F-35,

International Air Transportation Association (IATA) "Guidance Material for Aviation Turbine Fuels Specifications", 4th edition, March 2000, or United States Military Jet fuel specifications MIL-DTL-5624 (for JP-4 and JP-5) and MIL-DTL-83133 (for JP-8).

Middle distillate fractions as described herein boil in the range of about 250°–700° F. (121°–371° C.) as determine by the appropriate ASTM test procedure. The term "middle distillate" is intended to include the diesel, jet fuel and kerosene boiling range fractions. The kerosene or jet fuel boiling point range is intended to refer to a temperature range of about 280°–525° F. (138°–274° C.) and the term "diesel boiling range" is intended to refer to hydrocarbon boiling points of about 250°–700° F. (121°–371° C.). Gasoline or naphtha is normally the $C_5$ to 400° F. (204° C.) endpoint fraction of available hydrocarbons. The boiling point ranges of the various product fractions recovered in any particular refinery or synthesis process will vary with such factors as the characteristics of the source, local markets, product prices, etc. Reference is made to ASTM standards D-975, D-3699-83 and D-3735 for further details on kerosene, diesel and naphtha fuel properties.

A finished lubricating base oil is useful for blending with a specified additive package for preparation of a finished lubricant. A finished lubricating oil base stock is specified by viscosity index, saturate and sulfur specifications. API Publication 1509: Engine Oil Licensing and Certification System, "Appendix E-API Base Oil Interchangeability Guidelines for Passenger Car Motor Oil and Diesel Engine Oils" describes base stock categories. A Group II base stock contains greater than or equal to 90 percent saturates and less than or equal to 0.03 percent sulfur and has a viscosity index greater than or equal to 80 and less than 120. A Group III base stock contains greater than or equal to 90 percent saturates and less than or equal to 0.03 percent sulfur and has a viscosity index greater than or equal to 120.

The method of the invention will be illustrated by the following exemplary process.

In this example process, a carbonaceous material is converted to a syngas comprising CO and $H_2$. Typical reforming methods for preparing CO and $H_2$ from this material include steam reforming, partial oxidation, dry reforming, series reforming, convective reforming, and autothermal reforming. Such processes are well known in the art. The syngas is reacted in a Fischer-Tropsch reaction zone to produce a light stream, boiling in the range of $C_5$+ to an endpoint in the range of 650–750° F., and a wax stream having an initial boiling point in the range of 650–750° F. The wax stream and/or the light stream may be processed in a number of alternative ways to produce the stabilized liquid mixture. Alternatives which may be contemplated include:

1. The wax stream and the light stream may be combined to make a blend feed stream, and the blend feed stream contacted in a hydrocracking reaction zone. The blend feed stream may optionally be hydrotreated prior to hydrocracking. At least a portion of the hydrocracker reaction zone effluent is passed to a fractionator, wherefrom a $C_4$− fraction and a $C_5$+ fraction are recovered. The $C_5$+ fraction is a stabilized product mixture which is suitable for transporting from the remote site to a market site for fractionation to prepare finished fuel products.
2. At least a portion of the hydrocracking reaction zone effluent is passed to a fractionator, and a $C_4$− fraction, a $C_5$+ fraction boiling in the range of $C_5$+ to an endpoint in the range of 650–750° F., and a heavy effluent having an initial boiling point in the range of 650–750° F. is recovered therefrom. In this embodiment, the heavy effluent may be recycled to the hydrocracking reaction zone for additional conversion, or transported separately to the market site for production of lubricating oil base stocks.
3. At least a portion of the wax stream is contacted with a hydrocracking catalyst in a hydrocracking reaction zone, and at least a portion the light stream is contacted with a hydrotreating catalyst in a hydrotreating reaction zone. At least a portion of the hydrocracking reaction zone effluent is blended with a portion of the hydrotreating reaction zone effluent, and the blend is passed to a fractionation zone and a $C_4$− fraction and a $C_5$+ fraction are recovered therefrom. The $C_5$+ fraction is a stabilized product mixture which is suitable for transporting from the remote site to a market site for further upgrading and/or fractionation to prepare finished fuel products and, optionally, one or more lubricating oil base stocks.
4. At least a portion of the wax stream is contacted with a hydrocracking catalyst in a hydrocracking reaction zone. At least a portion of the hydrocracking reaction zone effluent is blended with a portion of the light stream, and the blend is passed to a fractionation zone and a $C_4$− fraction and a $C_5$+ fraction are recovered therefrom. The $C_5$+ fraction is a stabilized product mixture which is suitable for transporting from the remote site to a market site for further upgrading and/or fractionation to prepare finished fuel products and, optionally, one or more lubricating oil base stocks.
5. At least a portion of the wax stream is contacted in a hydrocracking reaction zone, and at least a portion of the light stream is combined with the effluent from the hydrocracking reaction zone and the blend stream contacted in a hydrotreating reaction zone. At least a portion of the hydrotreating reaction zone effluent is passed to a fractionator and a $C_4$− fraction and a $C_5$+ fraction are recovered therefrom. The $C_5$+ fraction is a stabilized product mixture which is suitable for transporting from the remote site to a market site for further upgrading and/or fractionation to prepare finished fuel products and, optionally, one or more lubricating oil base stocks.

Additional alternatives for hydroprocessing the various streams produced in a Fischer-Tropsch process, including combinations of the alternatives recited above, are considered to be within the scope of the present invention.

The various process steps which may be useful in the present invention are now described in greater detail.

A Fischer-Tropsch process is the preferred method for converting the carbon-based resource to the stabilized product mixture. Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable reaction temperature and reaction pressure conditions. The Fischer-Tropsch reaction is typically conducted at temperatures of from about 300° to 700° F. (149° to 371° C.) preferably from about 400° to 550° F. (204° to 228° C.); pressures of from about 10 to 600 psia, (0.7 to 41 bars) preferably 30 to 300 psia, (2 to 21 bars) and catalyst space velocities of from about 100 to 10,000 cc/g/hr., preferably 300 to 3,000 cc/g/hr.

The products may range from $C_1$ to $C_{200}$+ with a majority in the $C_5$ to $C_{100}$+ range. The reaction can be conducted in a variety of reactor types, for example, fixed bed reactors containing one or more catalyst beds; slurry reactors; fluidized bed reactors; and a combination of different type reactors. Such reaction processes and reactors are well known and documented in the literature. A slurry Fischer-Tropsch process, which is a preferred process in the practice of the invention, utilizes superior heat (and mass) transfer characteristics for the strongly exothermic synthesis reaction and is able to produce relatively high molecular weight, paraffinic hydrocarbons when using a cobalt catalyst.

In a slurry process, a syngas comprising a mixture of $H_2$ and CO is bubbled up as a third phase through a slurry in a Fischer-Tropsch reactor. The reactor contains particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP 0609079, herein incorporated by reference in its entirety.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known.

At least one of the products recovered as a Fischer-Tropsch reaction zone effluent is useful in preparing the stabilized product mixture.

In a specific embodiment of the invention, the products from Fischer-Tropsch reactions performed in slurry bed reactors include a light product and a waxy product. The light product (i.e. the condensate fraction) includes hydrocarbons boiling below about 700° F. (e.g., tail gases through middle distillates), largely in the $C_5$–$C_{20}$ range, with decreasing amounts up to about $C_{30}$. The waxy product (i.e. the wax fraction) includes hydrocarbons boiling above about 650° F. (e.g., vacuum gas oil through heavy paraffins), largely in the $C_{20}$+ range, with decreasing amounts down to $C_{10}$. Both the light product and the waxy product are substantially paraffinic. The waxy product generally comprises greater than 70% normal paraffins, and often greater than 80% normal paraffins, sometimes approaching 100% normal paraffins. The light product comprises paraffinic products with a significant proportion of alcohols and olefins. In some cases, the light product may comprise as much as 50%, and even higher, alcohols and olefins.

There are a number of hydroprocessing processes which may be used in preparing the Fischer-Tropsch reaction zone effluent as the stabilized product mixture.

During hydrocracking, a hydrocracking reaction zone is maintained at conditions sufficient to effect a boiling range conversion of the VGO feed to the hydrocracking reaction zone, so that the liquid hydrocrackate recovered from the hydrocracking reaction zone has a normal boiling point range below the boiling point range of the feed. Typical hydrocracking conditions include: reaction temperature, 400° F.–950° F. (204° C.–510° C.), preferably 650° F.–850° F. (343° C.–454° C.); reaction pressure 500 to 5000 psig (3.5–34.5 MPa), preferably 1500–3500 psig (10.4–24.2 MPa); LHSV, 0.1 to 15 $hr^{-1}$ (v/v), preferably 0.25–2.5 $hr^{-1}$; and hydrogen consumption 500 to 2500 scf per barrel of liquid hydrocarbon feed (89.1–445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica, alumina, or a combination thereof. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

In general, hydrotreating reaction conditions are milder than those of hydrocracking, and are intended primarily for olefin and aromatic (if present in the reactant stock) saturation and for heteroatom (oxygen and, if present, sulfur and nitrogen) removal. Catalysts suitable for hydrotreating are designed with a relatively stronger hydrogenation function and a relatively weaker cracking function. Mild hydrotreating, for example to remove color bodies and sources of instability from lubricating base oils, is conducted at the lower hydrotreating temperatures. Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina-supported cobalt-molybdenum, nickel sulfide, nickel-tungsten, cobalt-tungsten and nickel-molybdenum. Typically such hydrotreating catalysts are presulfided.

When treating a substantially paraffinic feedstock, hydroisomerization reactions isomerize the paraffin molecules to improve low temperature properties, e.g. pour and cloud point, of the product. While substantial hydrocracking may occur during hydroisomerization, the two processes are differentiated in the present process by the reduced molecular weight conversion which occurs during hydroisomerization. Typical hydroisomerization conditions are well known in the literature and can vary widely. Isomerization processes are typically carried out at a temperature between 200° F. and 700° F., preferably 300° F. to 650° F., with a LHSV between 0.1 and 10 $hr^{-1}$, preferably between 0.25 and 5 $hr^{-1}$. Hydrogen is employed such that the mole ratio of hydrogen to hydrocarbon is between 1:1 and 15:1. Catalysts useful for isomerization processes are generally bifunctional catalysts that include a dehydrogenation/hydrogenation component and an acidic component. The acidic component may include one or more of amorphous oxides such as alumina, silica or silica-alumina; a zeolitic material such as zeolite Y, ultrastable Y, SSZ-32, Beta zeolite, mordenite, ZSM-5 and the like, or a non-zeolitic molecular sieve such as SAPO-11, SAPO-31 and SAPO-41. The acidic component may further include a halogen component, such as fluorine. The hydrogenation component may be selected from the Group VIII noble metals such as platinum and/or palladium, from the Group VIII non-noble metals such as nickel and tungsten, and from the Group VI metals such as cobalt and molybdenum. If present, the platinum group metals will generally make up from about 0.1% to about 2% by weight of the catalyst. If present in the catalyst, the non-noble metal hydrogenation components generally make up from about 5% to about 40% by weight of the catalyst.

A lubricating base oil is prepared from a heavy fraction having an initial boiling point in the range of 650–750° F. The heavy fraction may be transported as a component of the stabilized product mixture or it may be transported separately from the remote site. If in combination, the heavy fraction is recovered from the stabilized product mixture as a distillate or bottoms fraction during fractionation of the stabilized product mixture at the market site. In general, the heavy fraction will be hydroprocessed at the market site in the preparation of lubricating base oil. An example process includes fractionating the heavy fraction into one or more lubricating oil base stocks, hydroisomerizing each base stock individually, optionally dewaxing to remove residual amounts of wax, and mild hydrotreating to remove unstable compounds and color bodies in the preparation of the high quality, low pour point lubricating base oils. The lubricating oil base stock, which is the feedstock to the hydroisomerization step, may be the whole heavy fraction and a fraction thereof. Suitable fractions include a broad boiling fraction having an initial boiling point in the range of 650–750° F. and an end point in the range of 950–1050° F. Narrow boiling fractions are also suitable feedstocks to the hydroisomerization step. These narrow fractions are generally represented by viscosity (e.g. 4 cSt, 6 cSt, 12 cSt and the like) and have a boiling range extent of between 75° F. and 200° F. An example narrow fraction has an initial boiling point in the range of 650–750° F. and an end point in the range of 750–850° F.

Those skilled in the art will recognize or be able to ascertain using no more than routine experimentation many equivalents to the specific embodiments of the invention described herein. Such equivalents are intended to be encompassed by the following claims.

What is claimed is:

1. A method for preparing finished products from a Fischer-Tropsch synthesis process, the method comprising:

a) reacting a synthesis gas comprising $H_2$ and CO to form at least one Fischer-Tropsch effluent product at a remote site;

b) reacting at least a portion of the Fischer-Tropsch effluent product at hydroprocessing conditions to form a hydroprocessed effluent at the remote site;

c) separating at least a portion of the hydroprocessed effluent into at least a $C_4$− fraction and a stabilized product mixture at the remote site;

d) transporting at least a portion of the stabilized product mixture to a market site; and e) separating at least a portion of the stabilized product mixture at the market site into at least one finished fuel product.

2. The method according to claim 1 wherein the Fischer-Tropsch effluent product is a $C_5$+ product.

3. The method according to claim 1 wherein the hydroprocessing conditions includes hydrocracking conditions.

4. The method according to claim 1 wherein the at least one finished fuel product is a diesel fuel.

5. The method according to claim 1 wherein the stabilized product mixture is separated at the market site into at least one finished fuel product and a heavy fraction.

6. The method according to claim 5 wherein the heavy fraction has an initial boiling point in the range of 650–750° F.

7. The method according to claim 5 wherein the heavy fraction is separated into at least one lubricating oil base stock; and wherein the lubricating oil base stock is converted at hydroisomerization conditions to form a lubricating base oil.

8. The method according to claim 6 wherein the heavy fraction has a boiling endpoint in the range of 950° F.–1100° F.

9. The method according to claim 1 wherein the stabilized product mixture boils in the range of $C_5$ to an endpoint in the range of 650–750° F.

10. The method according to claim 1 wherein the hydroprocessed effluent is separated into at least a $C_4$− fraction, a stabilized product mixture and a heavy effluent.

11. The method according to claim 10 wherein at least a portion of the heavy effluent is combined with at least a portion of the Fischer-Tropsch effluent product for reaction at hydroprocessing conditions.

12. The method according to claim 10 wherein the hydroprocessing conditions includes hydrocracking conditions.

13. The method according to claim 10 wherein the stabilized product mixture boils in the range of $C_5$ to an endpoint in the range of 650–750° F.

14. The method according to claim 13 wherein the at least one finished fuel product is a diesel fuel.

15. A method for preparing finished products from a Fischer-Tropsch synthesis process, the method comprising:

a) receiving a stabilized product mixture recovered from a Fischer-Tropsch synthesis process, which stabilized product mixture is prepared by the process comprising:

i) reacting a synthesis gas comprising $H_2$ and CO to form at least one Fischer-Tropsch effluent product;

ii) reacting at least a portion of the Fischer-Tropsch effluent product at hydroprocessing conditions to form a hydroprocessed effluent;

iii) separating at least a portion of the hydroprocessed effluent into at least a $C_4$− fraction and a stabilized product mixture; and iv) transporting at least a portion of the stabilized product mixture to a market site;

b) separating at least a portion of the stabilized product mixture without additional hydroprocessing into at least one finished fuel fraction at the market site;

wherein the stabilized product mixture is prepared at a remote site relative to the market site.

16. The method according to claim 15 wherein the stabilized product mixture comprises:

a) greater than 80 wt % paraffins, b) less than 200 ppm oxygen as oxygenates, c) less than 50 ppm sulfur, d) less than 50 ppm nitrogen, and e) less than 5% (v/v) olefins.

17. The method according to claim 15 wherein the finished fuel product is a diesel fuel.

18. The method according to claim 15 wherein the stabilized product mixture is a $C_5$+ product.

19. The method according to claim 15 wherein the stabilized product mixture is further separated into a heavy fraction having an initial boiling point in the range of 650–750° F.

20. The method according to claim 19 wherein the heavy fraction is separated into at least one lubricating oil base stock; and wherein the lubricating oil base stock is converted at hydroisomerization conditions to form a lubricating base oil.

21. The method according to claim 15 wherein the stabilized product mixture comprises greater than 90 wt % paraffins.

22. The method of claim 1, wherein the stabilized product mixture has a true vapor pressure of less than about 15 psia when measured at the mixture's transportation temperature.

23. The method of claim 1, wherein the stabilized product mixture has a true vapor pressure of less than about 11 psia when measured at the mixtures's transportation temperature.

24. The method of claim 15, wherein the stabilized product mixture has a true vapor pressure of less than about 15 psia when measured at the mixture's transportation temperature.

25. The method of claim 15, wherein the stabilized product mixture has a true vapor pressure of less than about 11 psia when measured at the mixtures's transportation temperature.

* * * * *